US005775675A

United States Patent [19]

Sicking et al.

[11] Patent Number: 5,775,675

[45] Date of Patent: Jul. 7, 1998

[54] SEQUENTIAL KINKING GUARDRAIL TERMINAL SYSTEM

[75] Inventors: Dean L. Sicking; John D. Reid; John E. Rohde, all of Lincoln, Nebr.

[73] Assignee: Safety By Design, Inc., Lincoln, Nebr.

[21] Appl. No.: 832,422

[22] Filed: Apr. 2, 1997

[51] Int. Cl.[6] ..... E01F 15/04

[52] U.S. Cl. ..... 256/13.1; 256/65

[58] Field of Search ..... 256/13.1; 404/65, 404/6, 9

[56] References Cited

U.S. PATENT DOCUMENTS

| | | | |
|---|---|---|---|
| 3,451,319 | 6/1969 | Gubela | 404/9 X |
| 4,928,928 | 5/1990 | Buth et al. | 256/13.1 |
| 5,078,366 | 1/1992 | Sicking et al. | 256/13.1 |
| 5,407,298 | 4/1995 | Sicking et al. | 256/13.1 X |
| 5,547,309 | 8/1996 | Mak et al. | 256/13.1 X |
| 5,642,792 | 7/1997 | June . | |

*Primary Examiner*—Anthony Knight

*Attorney, Agent, or Firm*—Miller, Sisson, Chapman & Nash, P.C.

[57] ABSTRACT

A highway guardrail terminal system having horizontally extending guardrail elements mounted on a plurality of posts. An impact head is positioned over the upstream end of the guardrail. A kinker beam is attached to an inlet of head and a kinking deflector plate is affixed inside the head. The deflector plate extends transversely across the head from the inlet to the outlet and has a multiplicity of discrete, intersecting angular faces. Upon impact of a vehicle with the head, the head is horizontally displaced along the rail elements of the guardrail. As the rail elements impact the deflector plate, kinks or plastic hinges are created in the elements. The impact energy is dissipated by the controlled kinking of the guardrail beams. An anchor cable release bracket attached to a rail element by sleeved mounting bolts has an arrangement of slots and openings to quickly release an anchor cable system from the guardrail. Foundation sleeves having an elongated slit along one side retain and support appropriate guardrail posts. A crash attenuation system may be provided with a plurality of kinker beams and kinking deflector plates for kinking a plurality of rail elements. The attenuation may be mounted to a head wall or mounted on a truck.

14 Claims, 8 Drawing Sheets

SEQUENTIAL KINKING GUARDRAIL TERMINAL SYSTEM

BACKGROUND OF THE INVENTION

The present invention relates to an energy dissipation system for use with impact attenuation devices, such as guardrail terminals, crash cushions, and truck mounted attenuators. Specifically, the invention relates to a mechanism for sequentially kinking a rail element during vehicular impacts. Applications of this invention include: end treatments for longitudinal barriers, crash cushions, and truck mounted attenuators.

Numerous end treatments have been developed for the W-beam type guardrail systems. Guardrail end treatments are designed to anchor the end of the guardrail for impacts on the side of the barrier and to safely accommodate vehicles impacting head-on into the end of the barrier. During head-on impacts, the terminal can either allow controlled penetration of the guardrail end, or attenuate impact energy to bring the vehicle to a safe and controlled stop. The break away cable terminal (BCT) end treatment was designed to cause a W-beam to buckle out of the way of an impacting vehicle. While the design uses the concept of a dynamic buckling of the W-beam, it has not been effective. There are other terminal designs based on the concept of dynamic buckling of the W-beam, such as the Eccentric Loader Terminal (ELT), U.S. Pat. No. 4,678,166, and the Modified Eccentric Loader Terminal (MELT), that have been shown to be more effective than the BCT. The Slotted Rail Terminal (SRT), U.S. Pat. No. 5,407,298, controls the dynamic buckling and reduces the buckling force by cutting longitudinal slots in the W-beam rail element.

Another treatment is the vehicle attenuating terminal (VAT), U.S. Pat. No. 4,655,434. VATs consist of overlapped guardrail sections that have a series of closely spaced slots. The guardrail segments are attached by bolts extending through the slots. When a vehicle impacts the end of this terminal, the bolts are forced to tear through the W-beam from one slot to the next. The W-beam segments are cut into several long ribbons as an impacting vehicle is decelerated.

Yet another end treatment utilizes an extruder terminal (ET). U.S. Pat. No. 4,928,928 discloses the details of the ET end treatment. With the ET end treatment, the W-beam guardrail is squeezed to a flattened condition in an extruder throat, bent along a bending chute into a curvilinear arc in a direction away from the impacting vehicle, and exits the extruder terminal. Impact energy is dissipated in the flattening process. Generally, the average force levels required with the ET design are approximately 12,000 pounds with little flexibility with regard to the extent of energy dissipated.

Another end treatment, known commercially as the BEST terminal, incorporates a cutting section in a manner to cut the beam of the guardrail as the means of energy dissipation. The cutting section includes a tube having one or more cutting members within it and a deflection plate. The level of energy absorption may be controlled by varying the thickness of the metal or using other material for the beam or using additional shear type cutters.

The energy dissipation system of the present invention utilizes an uniquely different concept. A sequential kinking mechanism attenuates impact energy by generating kinks, or plastic hinges, in the rail element at discrete locations. The mechanism sequentially kinks the rail element in small sections with incremental increases in the degree of bending as the result of discrete angular intersecting faces on the deflector plate. The rail may be provided with slots to aid in reducing the forces required to generate kinks in the rail element. Through this kinking mechanism the rate of energy dissipation and force level are controlled by: (a) the length of the kink which is a function of the distance between a kinker beam and the deflector plate; (b) the angles of the deflector plate; and (c) the size and locations of slots cut on the rail element.

There is no squeezing or cutting of the rail in the kinking mechanism.

Additionally, the present invention provides an improved quick release cable mechanism and improved sleeved mounting bolts. Further, since the prior art systems have resulted in excessive time being required to repair or replace the broken or severed posts after an impact, the present invention includes unique elongated foundation sleeves for retaining and supporting appropriate posts within the system.

SUMMARY OF THE PRESENT INVENTION

The present invention is a highway guardrail or crash attenuation system which comprises a horizontally extending guardrail mounted on a plurality of rail posts. The guardrail is mounted, along a vertical axis, to the posts. An improved impact head terminal member is slidingly positioned at a first end over the guardrail. The back end of the impact head is provided with an engaging plate which is designed to generally receive the engagement of an impacting vehicle. At the front end of the impact head, an inlet is provided to receive the leading end of the guardrail. A guide tube is attached to the inlet to guide the guardrail into the inlet. Further, attached at the inlet is a kinker beam which cooperates with a kinking deflector plate rigidly attached within and extending transversely across the head to generate kinks, or plastic hinges, in the rail element at discrete locations along the guardrail. The deflector plate is provided with a multiplicity of discrete, intersecting, angular faces upon which the rail element impacts as the impact head is horizontally displaced along the guardrail upon engagement of an impacting vehicle.

An anchor cable release bracket with tapered slots along a first side and enlarged openings along an opposite side is provided. The bracket is attached to the rail element by sleeved mounting bolts. The bracket is shifted laterally and then one side is forced away from the rail element and off of the mounting bolts upon impact of the guide tube.

Foundation sleeves having an elongated slit along one side of the sleeve and stiffing ribs extending across the slit are provided to retain and support guardrail posts. The elongated slits in the sleeve allow the sleeve to expand when the wood post swells due to moisture. The ability for the sleeve to expand outward facilitates removal of the post after a vehicular impact. The elongated slits also simplify the fabrication of the foundation sleeve by reducing the amount of welding and minimizing warping of the sleeve during the welding process.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
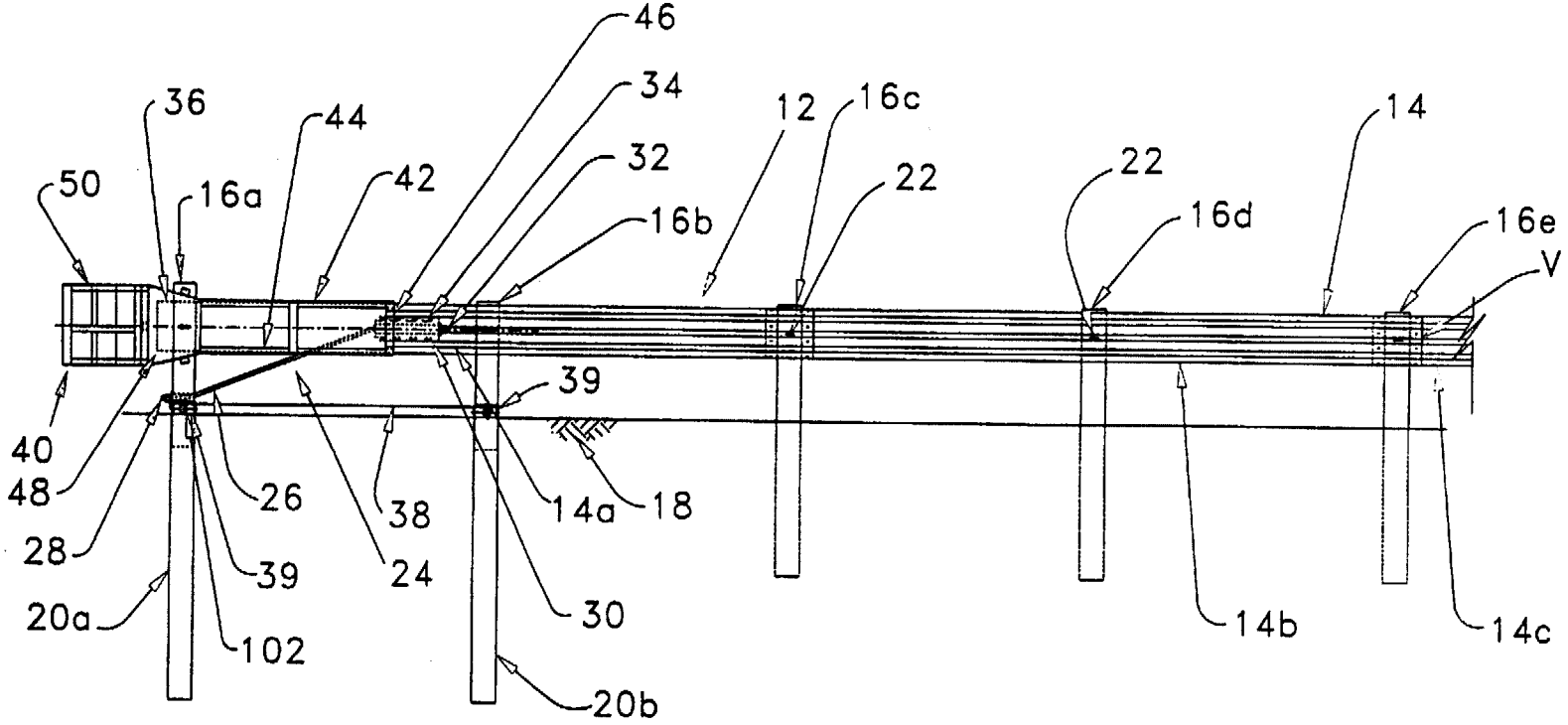
FIG. 1 illustrates a side elevation view of a first embodiment of the present inventive highway guardrail terminal system.

Referring now to the drawings, and more particularly to FIG. 1, the reference numeral (12) generally represents an energy dissipating guardrail terminal of the preferred invention using the sequential kinking concept. The terminal which is preferentially adapted to be connected to the upstream side of a conventional guardrail (14) consisting of standard W-beam guardrail sections, either approximately 12'6" or 25' in length. It should be understood that the sequential kinking concept is effective with other guardrail shapes and not only with the W-beam guardrail. The guardrail sections or rail elements (14*a*–14*c*) are attached along their vertical axes (V) by bolts (22) to a plurality of vertical breakaway posts (16*a*–16*e*) spaced apart approximately 6'3" from each other. Again, it should be understood that the sequential kinking terminal is effective with other spacing distances. Any suitable number of posts may be used depending upon the expanse of the guardrail run. FIG. 1 illustrates five wooden breakaway posts. Wooden posts (16*c*–16*e*) are shown embedded directly into the soil (18). Lead post (16*a*) and second post (16*b*), which are shorter in length than the other posts, are shown inserted within unique foundation sleeves (20*a* and 20*b*) which will be further described below.

Figure 7:
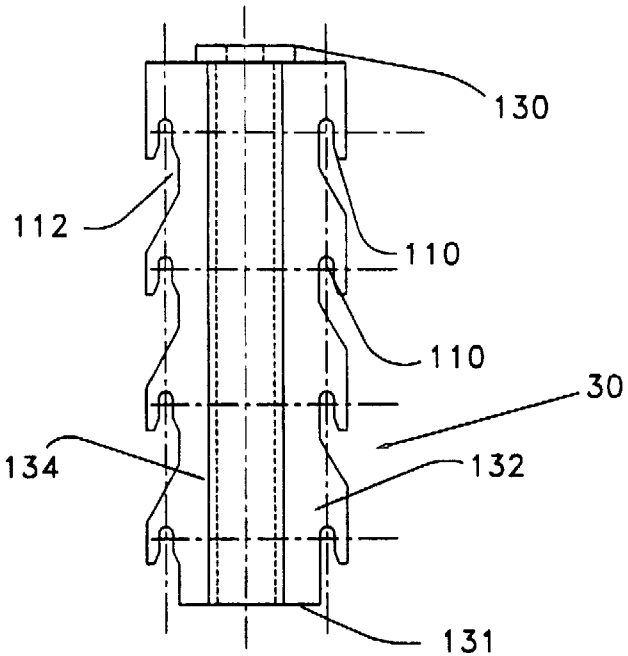
FIG. 7 illustrates a cable release bracket of the present invention.
Figure 9:
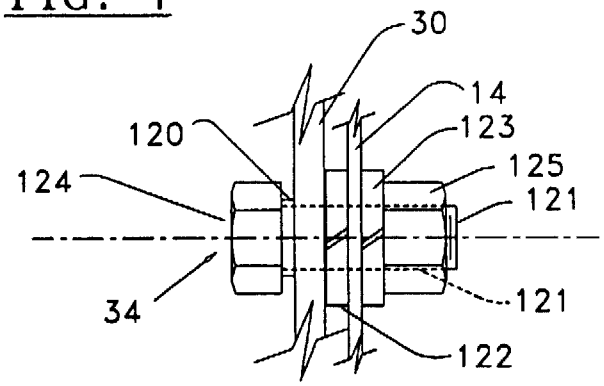
FIG. 9 illustrates a side elevation view of the quick release sleeved mounting bolt of the present invention.
Figure 8:
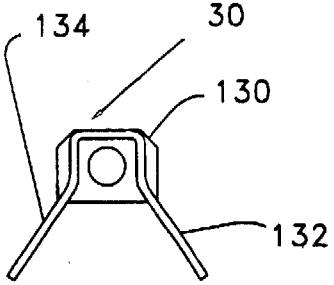
FIG. 8 illustrates an end view of a cable release bracket of the present invention.

FIG. 1 further illustrates an anchor cable mechanism (24) which includes an anchor cable (26), lower anchor cable bolt (28), a unique and novel anchor cable release bracket (30), an upper anchor cable bolt (32), and eight unique and novel sleeved bolts (34). The anchor cable mechanism is provided to allow the terminal (12) to withstand angular vehicle impacts downstream of its upstream end (36). FIGS. 7 and 8 show the detail construction of the quick release bracket which is held in tension on rail element (14*a*) by the sleeved bolts (34) (FIG. 9). In addition, a ground strut (38) having an M-shaped yoke (39) on each end extends between the first and second posts and is provided for additional support for the anchor cable forces. A bolt or fastener (102) extends through the yoke and the post to secure the strut in place.

It is intended that a vehicle will impact the guardrail (14) downstream of its upstream end (36); however, a collision with the end (36) requires the provision of an end treatment designated by reference numeral (40) to reduce the extent of injury to the impacting vehicle and its occupants. The purpose of the end treatment (40) is to dissipate impact energy of the vehicle.

Figure 2:
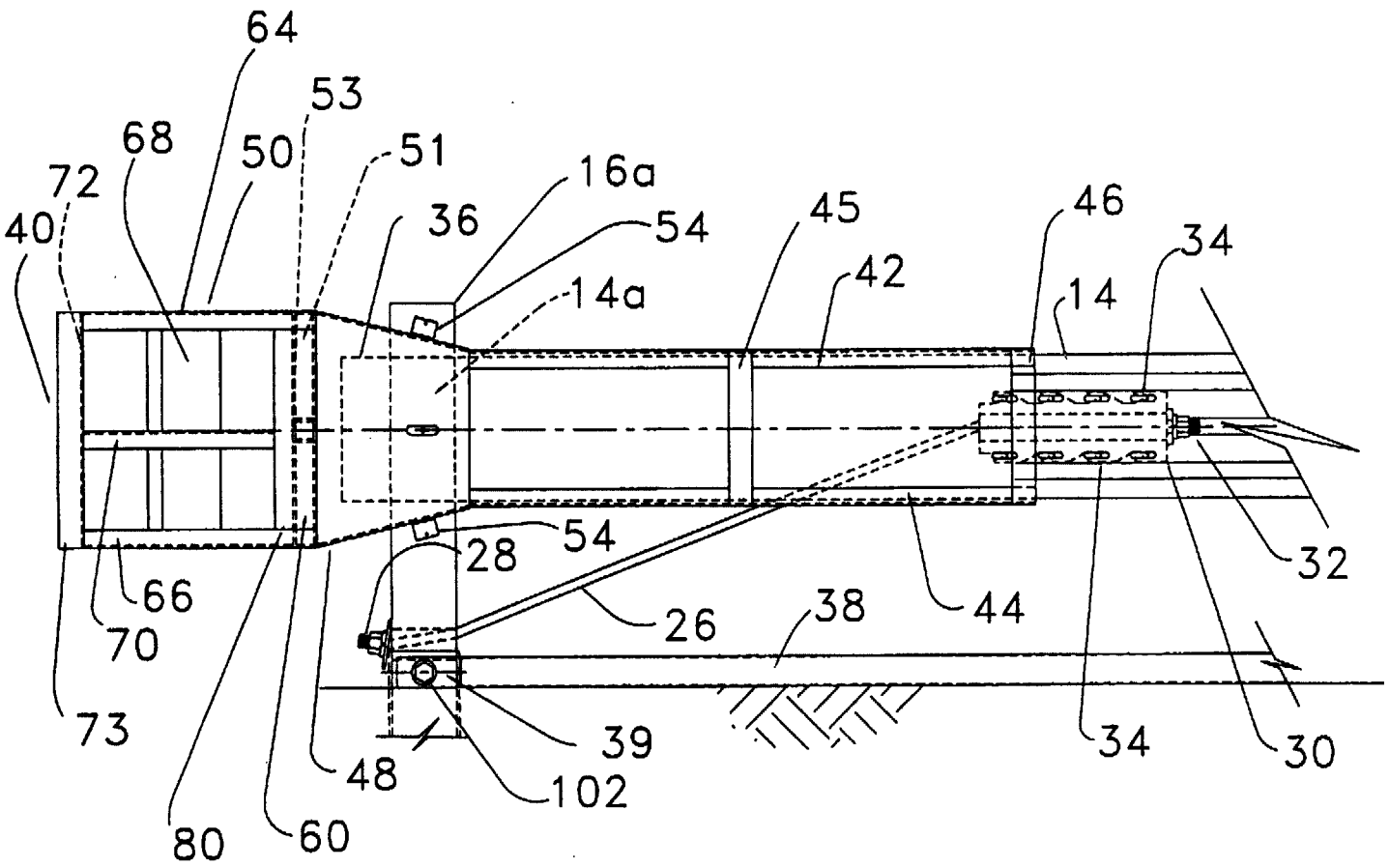
FIG. 2 illustrates a side elevation view of the impact head, guide tube, and cable release mechanism of the present invention.

FIG. 2 illustrates a side view of the end treatment (40). The end treatment (40) includes top guide rail (42), bottom guide rail (44), center guide rail strap (45), end guide rail straps (46), guide tube (48), impact head (50) and kinker beam (51). The impact head (50) is attached on the upstream end of guide tube (48). Guide tube (48) is mounted onto lead post (16*a*) by fasteners (52) passing through post angle brackets (54). The upstream end (36) of the rail element (14*a*) extends into the guide tube (48).

It may be seen that the top (42) and bottom (44) guide rails extend downstream along and above the upper and lower edges of the guardrail (14), respectively. Guide straps (45 and 46) maintain the top and bottom guide rails in spaced apart relation. The guide rails ensure that the W-beam rail (14) is guided properly into the guide tube (48) and impact head (50) without the impact head (50) or guide tube (48) rotating or twisting as the end treatment (40) moves down the length of the W-beam rail (14) during a collision.

Figure 3:
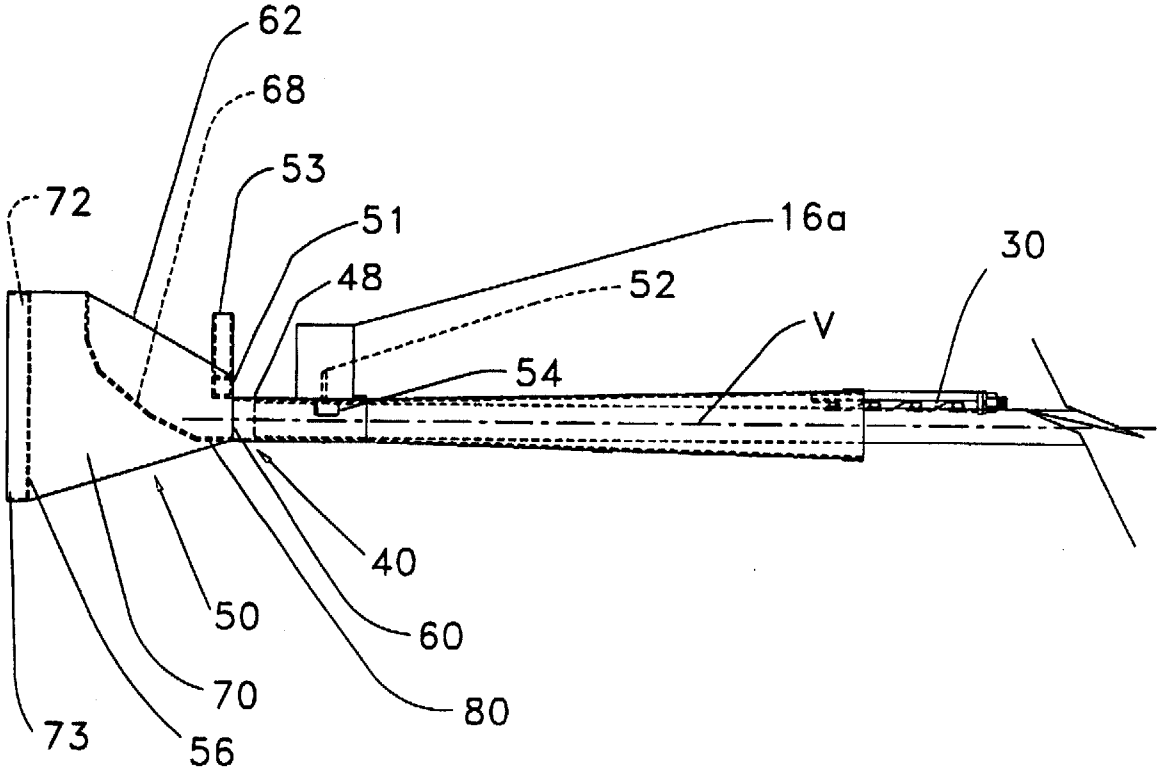
FIG. 3 illustrates a top view of the impact head, guide tube, and cable release mechanism of the present invention.

Impact head (50) has an inlet (60) and an outlet (62) (FIG. 3). A top plate (64), and a bottom plate (66), house a sequential deflector plate (68), a support gusset (70), and a front impact plate (72). At the inlet (60), the kinker beam (51) is attached to the top plate (64) and the bottom plate (66) and spaced apart from the first deflector face (80) of deflector plate (68). The kinker beam (51) of the preferred embodiment is a 20"×2"×2" steel box tube but any comparable sizing may be used.

It is through this inlet (60) (which is about 4" wide) between the first deflector face (80) and the kinker beam (51) that the W-beam rail element (which is about 3" wide) passes when the impact head (50) is displaced downstream along rail (14) during collision.

Extending generally perpendicular from the side of kinker beam (51) is a 6"×2"×2" box tube, post breaker (53). The post breaker beam (53) is welded to the kinker beam (51) and extends outwardly approximately 6" from the side of the kinker beam. Other suitable dimensions may be used. However, the length of the post breaker beam (53) is sufficient to extend the full width of the wood post (16*a*). The post breaker beam (53) is also generally perpendicular to the vertical axis (V) of the W-beam and is designed to engage and break the lead post (16*a*) when the impact head (50) is displaced downstream in a collision.

Post (16*a*) is provided with a 2½" diameter hole through which passes a portion of the anchor cable (26). The hole is positioned slightly above the yoke (39) of strut (38). When the impact head is displaced downstream in a collision, the post breaker beam engages the full width of post (16*a*) and post (16*a*) will snap or break at the hole in the post. By having the beam (53) extend the full width of the post (16*a*), the tests have shown that the post (16*a*) more easily and cleanly breaks just above the yoke (39) at the anchor cable hole.

FIG. 3 illustrates a top view of the sequential kinking deflector plate (68) which is welded inside of impact head (50) to the inside surface of top plate (64) and bottom plate (66). Deflector plate (68) is approximately ¼" thick and 20" in height. 20" is the distance top plate (64) is spaced apart from parallel bottom plate (66). The deflector plate (68) extends from the inlet (60) to the outlet (62) of the impact head (50).

Figure 4:
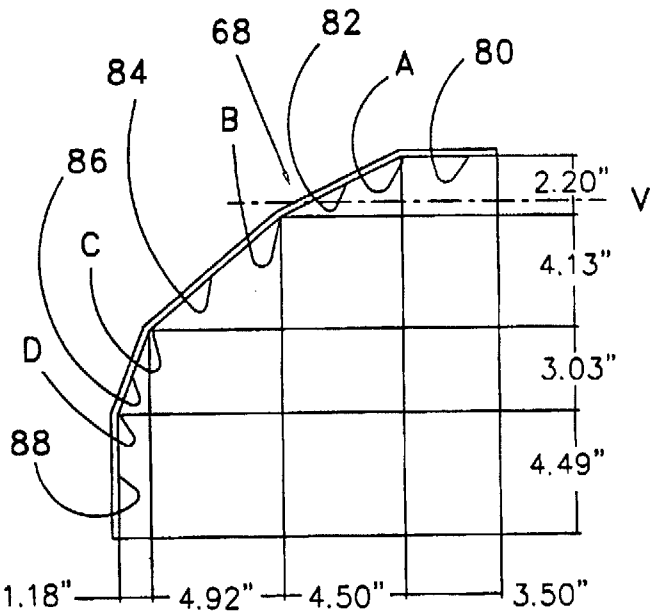
FIG. 4 illustrates a top view of the kinking deflector plate of the present invention.

As may be seen further in FIG. 4, the sequential kinking deflector plate (68) has a multiplicity of discrete, intersecting angular faces (80, 82, 84, 86 and 88). Each angular face is offset by a specific angle from the vertical axis (V) of the W-beam (14). First face (80) is parallel (0°) to the vertical axis of the beam (14). Second face (82) intersects with first face (80) and is offset by angle (A) of approximately 20° from the vertical axis (V) of the beam (14). Third face (84) intersects with second face (82) and is offset by angle (B) of approximately 400 from the vertical axis (V) of the beam (14). Fourth face (86) intersects with third face (84) and is offset by angle (C) of approximately 70° from the vertical axis (V) of the beam (14). Finally, fifth face (88) intersects with the fourth face (86) and is offset by angle (D) of approximately 90° from the vertical axis (V) of the beam (14). The outlet (62) is formed between top plate (64), bottom plate (66), and fifth face (88).

In FIG. 4, the first face is approximately 3.5" wide, second face is approximately 5.0" wide, third face is approximately 6.4" wide, fourth face is approximately 3.25" wide, and fifth face is approximately 4.5" wide. It should be understood that the kinking of the beam (14) may be varied by changing the discrete angular relationships; therefore, the face widths and angles may be varied in a reasonable range to achieve the specific energy dissipation desired.

The distance between the inside edge of the kinker beam (51) and the first face (80) of the deflector plate (68) is approximately 4" in the preferred embodiment. Again, the width of the opening may be varied within reasonable ranges in order to control the length of the kinks or plastic hinges formed in the beam (14). However, there is no squeezing extrusion of the beam (14) in the guide tube (48) or the impact head (50).

Because of the force loads which are placed upon the deflector plate (68), gusset plate (70) is welded generally perpendicularly against the outside of the deflector plate (68) and the back impact plate (72) as shown in FIGS. 2 and 3. Back impact plate (72) is attached to the upstream-most end of the impact head (50) and has protruded edges (73) to distribute the impact load and form a mechanical interlock with the colliding vehicle.

The sequential kinking concept of the present invention entails dissipation of the kinetic energy of the impacting vehicle through kinking of the rail element (14). When the end treatment (40) is impacted end-on by an errant vehicle, the impact plate (72) will engage and interlock mechanically with the front of the vehicle. As the vehicle proceeds forward, the impact head (50) will be moved forward or downstream along the rail element (14). The post breaker beam (53) on the side of the kinker beam (51) will contact and break off the first or lead breakaway wooden post (16*a*), thus releasing the tension on the cable (26) of the cable anchorage system (24).

At or shortly after breaking of the lead post (16*a*), the end (36) of the rail element (14*a*) will contact the second face (82) of the deflector plate (68) within the impact head and kink a short section of the rail element because of the angle (20°) built into the second face (82). This kink or plastic hinge in the rail element allows the rail deformation to be localized and thereby control the amount of energy dissipated. By designing the system to have wider or narrower spacing between the kinks, the amount of energy dissipation can be reduced or increased, respectively.

The kinked section of the rail element will then sequentially contact the third, the fourth, and the fifth faces of the deflector plate and the extent of the kink will increase due to the larger angles of the third (40°), fourth (70°), and fifth (90°) faces. The kinked section will then exit the impact head (50) through outlet (62) on the backside of the impact head (50) away from the traffic.

This kinking process will continue as the vehicle proceeds forward and pushes the impact head (50) along. As the downstream portion of the guide tube reaches the unique and novel cable release bracket (30) on the rail element (14*a*), the cable release bracket, which is held on rail (14) by the unique and novel sleeved bolts (34), will be pushed forward, slide off the bolts (34), and be released from the rail element (14*a*).

The kinking process will continue until: (a) the kinetic energy of the impacting vehicle is totally dissipated and the vehicle comes to a safe and controlled stop against the impact head, or (b) the vehicle yaws out and disengages from the impact head, by which time sufficient kinetic energy would have been dissipated so that the vehicle would gradually come to a safe and controlled stop close to the guardrail installation.

For impacts that are either end-on at a large angle or near the end of the end treatment (40) (e.g., between posts 16*a* and 16*b*), the impacting vehicle will break off the first couple of posts, bend the rail element, and gate behind the end treatment (40) and guardrail installation.

For impacts into the side of the terminal downstream of the beginning of length-of-need which is selected to be at the third post (16*c*) or 12'6" downstream from the terminal end (36), the terminal (12) will act like a standard guardrail section and will contain and redirect the impacting vehicle. The cable attachment system (24) and ground strut (38) will provide the necessary anchorage to resist the tensile forces acting on the rail element to contain and redirect the vehicle.

Figure 5:
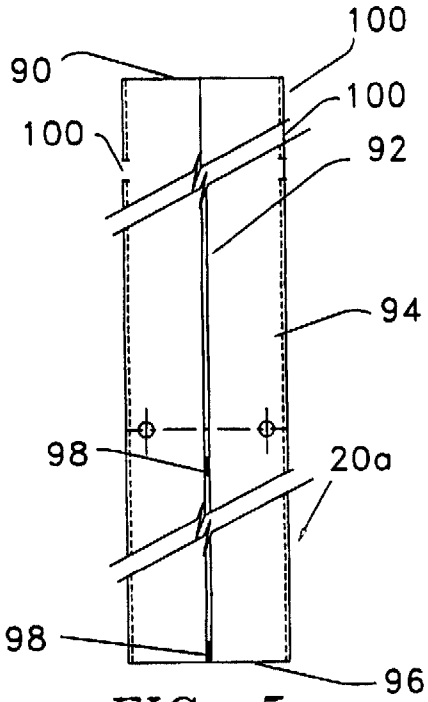
FIG. 5 illustrates a side elevation view of the foundation sleeve of the present invention.
Figure 6:
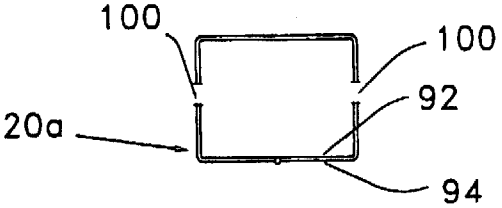
FIG. 6 illustrates a top view of the foundation sleeve of the present invention.

As discussed previously, the first two posts (16*a* and 16*b*) are received at one end into the top or proximal end (90) of the unique and novel elongated foundation sleeves (20*a* and 20*b*). FIGS. 5 and 6 show the structure of the foundation sleeve (20*a*). A plate of metal is bent to form the tube-like configuration of the sleeves; however, an elongated slit (92) extends along one side (94) of the sleeves from the proximal end (90) to the distal end (96). A plurality of stiffing ribs (98) are formed by providing a multiplicity of 2" welds across the slit (92) along the distal two-thirds portion of the sleeve at space apart locations.

The sleeve is provided with post retaining bolt receiving orifice (100) which allows for a bolt (102) to pass through the sleeve and through the post (16*a* or 16*b*) to retain the post in the sleeve. Further, the yoke (39) of ground strut (38) is fastened to the foundation sleeve by bolt (102). When a post is broken off in a collision with the guardrail system (12), the stub remaining in the sleeve may be easily removed from the sleeve by removing the bolt (102) and pulling the stub from the sleeve. The elongated slit (92) further facilitates the removal of a wet or swollen stub by allowing maintenance personnel to insert a tool in slit (92) and increase the opening in the proximal end of the sleeve to remove the stub.

The unique cable release mechanism (24) serves the dual functions of: (1) transmitting the tensile force from the rail element (14*a*) to the lead post (16*a*) and the foundation sleeve (20*a* or 20*b*) via the cable anchor assembly (24) for impacts with the side of the guardrail; i.e., redirectional impacts; and (2) releasing the cable bracket (30) from the rail element (14) so that the rail element may properly feed through the impact head (50).

The cable release mechanism of the present invention incorporates a novel and unique cable release bracket (30)

with sleeved bolts (34). FIGS. 7 and 8 show that cable release bracket (30) is fabricated in a manner similar to the standard cable anchor bracket by cutting angled slots (110) into the bracket. In head-on impacts, the leading edge of the guide tube will impact the upstream end (31) of the bracket (30) and push the bracket forward, thus releasing the bracket (30) from sleeve (120) of the mounting bolts (38) (see FIG. 9) attached to the rail element (14). As may be seen in FIG. 9, the rotatable sleeve (120) provides a fixed space between washer (122) and bolt head (124).

The cable release bracket 30 has tapered or wedged slots (110) on one side and enlarged tapered openings (112) which fit behind the mounting bolts on the opposite side.

In FIG. 8 it may be seen that the sides (132 and 134) of bracket (30) lie in two different planes. Having the tapered slot (110) on one side and the enlarged tapered slots (112) on the other side allows the bracket to be affixed to a W-beam in two rows in two different slip planes and still be lifted off the rail element when the bracket (30) is pushed forward in a collision. Without the opposed enlarged tapered slots (112), the bracket would not freely release from the rail element.

To further improve the release of the anchor cable system (24) the bracket (30) is attached to the rail element by specially designed sleeved bolts (34). FIG. 9 illustrates that bolt (34) is provided with a head (124) and a rotatable sleeve (120) which slides over the bolt shank (121). A washer or spacer (122) is welded or otherwise rigidly affixed to the shank so as to provide a fixed gap or space between the head (124) and the spacer (122). The anchor cable bracket (30) slides over the rotatable sleeve (120) with the bolt (34) fitting into the appropriate slots (110 and 112). The bolts (34) are affixed to the rail element (14) by passing the shank (121) through a hole or slot in the element and tightening washer (123) against the back side of the element with nut (125). Because the fixed space between head (124) and space (122) is greater than the thickness of the bracket, and because the bracket may easily slide over the rotatable sleeve (120), the bracket (30) is quickly and easily released upon a head-on impact. However, the bracket is not released upon a side impact.

Figure 10:
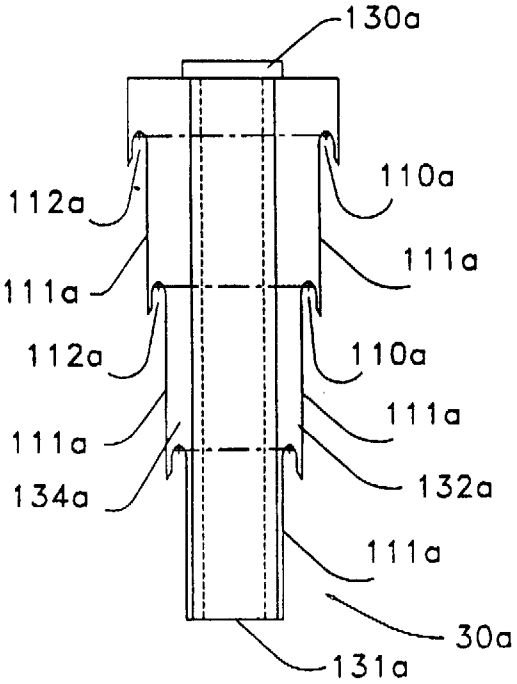
FIG. 10 illustrates an alternative embodiment of a cable release bracket of the present invention.

An alternative embodiment of an anchor cable bracket (**30*a*) of the present invention is shown in FIG. 10. In bracket (30*a*) the two side walls (132*a* and 134*a*), which lie in different planes, are provided with slots (110*a* and 112*a*); however, the size of the slot opening is the same. An extended, straight slip ceiling (111*a*) is associated with each slot. When the bracket (30*a*) is pushed forward upon a head-on impact, rotatable sleeve (120) of the sleeve bolts (34) slides along slip ceiling (111*a*) until the bolt head (124) is out of the slot (110*a* or 112*a***), and the bracket may fall from the rail element.

The sequential kinking mechanism of the present invention may be used in applications other than a guardrail terminal. Such applications include crash attenuators or cushions and truck mounted attenuators.

Figure 11:
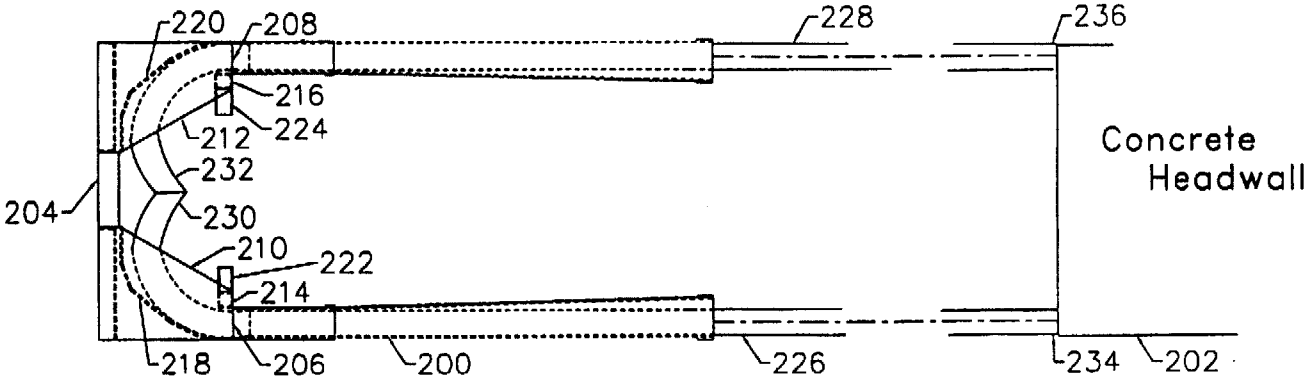
FIG. 11 illustrates a crash cushion of the present invention.

FIG. 11 illustrates a crash cushion or attentuator 200 cooperatively mounted to a concrete head wall (202). As will be understood from the previous discussion of the guardrail system (12) above, an impact head (204) having two separate inlets (200 and 208), two separate outlets (210 and 212), two separate kinking beams (214 and 216), two separate kinking deflector plates (218 and 220), and two separate post breaker beams (222 and 224) may be used to sequentially kink two separate rail elements (226 and 228). The leading ends (230 and 232) of the rail elements may be connected to improve the controlled discharge of the kinked elements.

Figure 12:
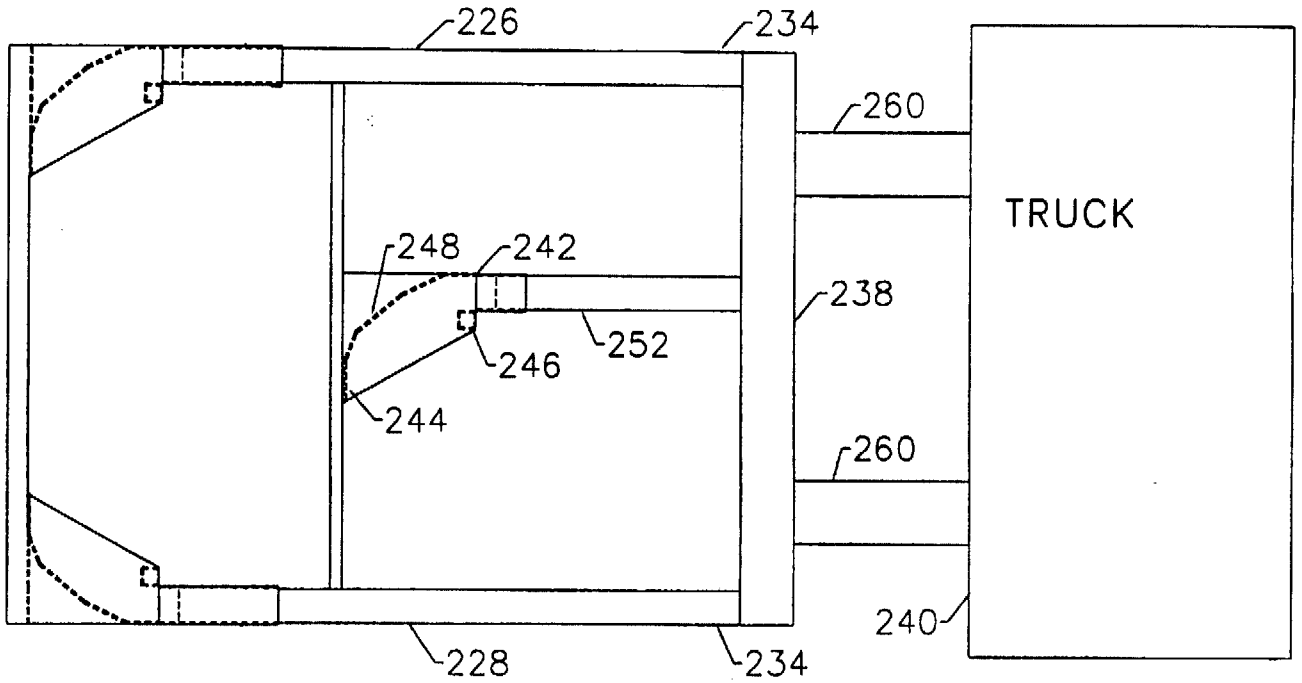
FIG. 12 shows a truck mounted attenuator of the present invention.

One of ordinary skill in the art will readily understand how downstream ends (234 and 236) of the rail elements may be affixed to an end plate (238) and mounted to a truck (249) by mounting brackets or cylinders (260) to provide a truck attentuator (262). FIG. 12 illustrates such an arrangement.

FIG. 12 further illustrates how a third inlet (242), outlet (244), kinking beam (246), and kinking deflector plate (248), may be used to sequentially kink a third rail element (250). When mounted to a truck, no post breaker beams are necessary.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A crash attenuation impact head for use with a rail element comprising:

an inlet for receiving said rail element;

an outlet for discharging said rail element;

a kinker beam attached to said inlet of said head;

a kinking deflector plate attached within said head and extending from said inlet to said outlet, said deflector plate having a multiplicity of discrete intersecting angular faces whereby upon impact to said impact heads impact energy is dissipated in incremental amounts through the sequential kinking of said rail element as it passes by said beam, through said head, and out said outlet.

2. A highway crash attenuation system comprising:

a horizontally extending rail element having a generally vertical axis;

an impact head for engaging an impacting vehicle slidingly positioned at a first end over a first end portion of said rail element, said impact head further comprising:

a front impact plate attached to a second end of said impact head;

an inlet for receiving said first end portion of said rail element;

an outlet for discharging said rail element;

a kinker beam attached to said inlet of said head;

a kinking deflector plate rigidly attached within said head and extending transversely across said head from said inlet to said outlet, said deflector plate having a multiplicity of discrete intersecting angular faces whereby impact energy is dissipated in incremental amounts through the sequential kinking of said rail element as it passes by said beam, through said head, and out said outlet upon impact to said head.

3. The system of claim 2 further comprising:

a second horizontally extending rail element having a second generally vertical axis;

said impact head further slidingly positioned at said first end over a first end portion of said second rail element and further comprising:

a second inlet for receiving said first end of said second rail element;

a second outlet for discharging said second rail element;

a second kinker beam attached to said second inlet;

a second kinking deflector plate rigidly attached within said head and extending transversely across said head from said second inlet to said second outlet, said second deflector plate having a multiplicity of discrete intersecting angular faces, whereby upon impact to said head impact energy is dissipated in incremental amounts through the sequential kinking of said rail elements as they pass by said beams, through said head, and out said outlets.

4. The system of claim 3 wherein said first end of said first rail element is attached to said first end of said second rail element.

5. The system of claim 2 wherein said system is mountable on a truck.

6. The system of claim 2 further comprising a guide tube attached to said inlet of said impact head to guide said rail element into said inlet upon horizontal displacement of said impact head.

7. The system of claim 2 further comprising a post breaker extending generally perpendicularly from said kinker beam and said vertical axis of said rail element such that upon engagement of said impacting vehicle and horizontal displacement of said impact head along said rail element said post breaker engages the full width of and breaks at least the first of a plurality of posts on which said rail element is mounted.

8. The system of claim 2 further comprising an elongated foundation sleeve for receiving in a proximal end a first end of a first of said plurality of posts, said sleeve having an elongated slit along one side of said sleeve extending from said proximal end to a distal end, said slit having a plurality of stiffing ribs extending thereacross at a distal portion of said sleeve.

9. The system of claim 1 wherein said kinking deflector plate further comprises a first face parallel to said vertical axis of said rail element, a second face intersecting said first face and offset approximately 20° from said vertical axis of said rail element, a third face intersecting with said second face and offset approximately 40° from said vertical axis of said rail element, a fourth face intersecting said third face and offset approximately 70° from said vertical axis of said rail element, and a fifth face intersecting with said fourth face and offset approximately 90° from said vertical axis of said rail element.

10. The system of claim 9 wherein said kinking deflector plate has a vertical height of approximately 20", said first face approximately 3.5" wide, said second face approximately 5.0" wide, said third face approximately 6.4" wide, said fourth face approximately 3.25" wide, and a fifth face approximately 4.5" wide.

11. The system of claim 2 wherein said rail element further comprises a first section, said first section having a plurality of horizontally extending spaced apart slots to reduce the force required to kink said first section as said first section impacts said kinking deflector plate upon engagement of said impacting vehicle and horizontal displacement of said impact head along said rail element.

12. The system of claim 2 further comprising:

a foundation sleeve for a guardrail post which supports said rail element comprising:

an elongated tube having an opening in a proximal end for receiving a first end of said post, said tube having an elongated slit along one side of said tube extending from said proximal end to a distal end, said slit having a plurality of stiffing ribs extending across said slit at a distal portion of said tube.

13. The system of claim 2 further comprising:

an anchor cable release mechanism comprising:

a plurality of mounting bolts connected to rail element of said attenuation system, a cable release bracket releasably attachable to said bolts, said bracket having a first side with a plurality of tapered slots slidingly engageable on sleeved sections of a first set of said bolts and a second side having enlarged openings for engaging a second set of said bolts, said bracket slidable upon said sleeved sections of first set of said bolts and along said tapered slots so as to lift said bracket from said second set of said bolts.

14. The system of claim 13 wherein each of said mounting bolts further comprises:

a shank having a first end extendable through an opening in said rail element;

a head rigidly attached to a second end of said shank;

a fixed spacer rigidly attached to a mid portion of said shank and spaced apart from said head; and a sleeve rotatably positioned over said shank between said head and said spacer.

* * * * *